United States Patent [19]

Dyrkorn

[11] Patent Number: 4,884,985

[45] Date of Patent: Dec. 5, 1989

[54] ELASTICALLY SUPPORTED THRUSTER STRUCTURE

[75] Inventor: Arnfinn Dyrkorn, Molde, Norway

[73] Assignee: Brödr. Brunvoll Motorfabrikk A/S, Molde, Norway

[21] Appl. No.: 802,338

[22] Filed: Nov. 25, 1985

Related U.S. Application Data

[62] Division of Ser. No. 645,744, Aug. 28, 1984, Pat. No. 4,629,432.

[30] Foreign Application Priority Data

Feb. 4, 1983 [NO] Norway ..... 830384

[51] Int. Cl.[4] ..... B63H 21/30

[52] U.S. Cl. ..... 440/52; 114/151; 60/221; 181/207

[58] Field of Search ..... 248/631, 636; 267/113; 415/119; 440/52, 89, 70; 114/151, 67 A; 181/207, 208, 209, 210; 60/221

[56] References Cited

U.S. PATENT DOCUMENTS

| | | | |
|---|---|---|---|
| 1,348,828 | 8/1920 | Fessenden | 114/270 |
| 3,884,174 | 5/1975 | Larsen | 440/52 |
| 4,399,974 | 8/1983 | Takei | 248/631 |

FOREIGN PATENT DOCUMENTS

| | | | |
|---|---|---|---|
| 2304825 | 8/1974 | Fed. Rep. of Germany . | |
| 2734876 | 2/1979 | Fed. Rep. of Germany | 114/151 |
| 2803336 | 8/1979 | Fed. Rep. of Germany . | |
| 135462 | 10/1975 | Norway . | |
| 706287 | 12/1979 | U.S.S.R. | 440/89 |
| 1419546 | 12/1975 | United Kingdom | 114/151 |

*Primary Examiner*—Joseph F. Peters, Jr.
*Assistant Examiner*—Thomas J. Brahan
*Attorney, Agent, or Firm*—Wenderoth, Lind & Ponack

[57] ABSTRACT

A propeller thruster installation includes a propeller unit rigidly supported in an inner tunnel tube which in its turn is elastically coaxially supported in an outer tunnel tube which is rigidly secured to the hull of a ship. In order to reduce the transmission of noise and vibrations from the propeller unit to the interior of the ship an annulus between the outer and inner tunnel tubes is filled with, a continuously maintained "bubble curtain" of air.

4 Claims, 3 Drawing Sheets

1
1'
2
3
4
5
6
7
8
9
12
12'
13
14
15
16
17
18
II
II

ELASTICALLY SUPPORTED THRUSTER STRUCTURE

This is a division of application Ser. No. 645,744, filed Aug. 28, 1984, now U.S. Pat. No. 4,629,432.

BACKGROUND OF THE INVENTION

The present invention relates to an elastically supported propeller installation or thruster for propulsion and/or steering of ships. More particularly it relates to a thruster of the type in which a propeller is operating in an open tunnel through the hull of the ship. Thrusters can be the source of a considerable noise and vibration level in a ship. Force pulses of a mechanical origin (bearings, gears and other transmission components) or of a hydrodynamic origin (inhomogeneous flow to propeller, cavitation etc.) occur in thrusters and tunnel tubes. These force pulses produce vibrations in the thruster and tunnel structures, and if the latter components are rigidly connected to the hull the vibrations will propagate through the hull structure and radiate in the form of acoustic noise in the interior fittings of the ship.

These structurally transplanted vibrations may cause high intensity noise over a wide frequency range. Typical noise levels in rooms adjacent to a conventional thruster installation are 80–90 dB(A).

If the design of the ship is such that people have to stay in this area, such noise levels will represent an unacceptable environmental strain on these people.

The object of the present invention is to provide a propeller thruster installation which is constructed in a manner to reduce as far as possible the vibrations transmitted from the propeller unit and tunnel to the hull of the ship, and to keep the noise in adjacent rooms at an acceptable level, while paying due attention to simplicity of installation and security of the ship.

A considerable noise and vibration dampening can be achieved by rigidly connecting the propeller unit with an inner tubular tunnel disposed coaxially within an outer tubular tunnel and secured to the latter by means of an elastic connection or isolator. This is a wellknown method for isolating machine vibrations from the surroundings. By adjusting the elastic properties of the isolator according to known rules a considerable amount of the oscillation energy excited in the thruster and the inner tunnel is prevented from spreading through the hull structure. However, this measure by itself is not sufficient to secure acceptable noise conditions in adjacent rooms. For additional noise-dampening it has been proposed to seal off the annulus between the inner, elastically mounted tubular tunnel and the outer, rigidly mounted tubular tunnel against the sea, and to confine a noise-dampening air volume in the annulus.

The dampening effect resulting from a such construction may reduce the noise level in adjacent rooms by the order of 15 dB(A).

However, a significant disadvantage in connection with this construction is that the sealed required between the tubular tunnels for insulating the confined air volume, apart from necessarily being large, complex and therefore expensive, are located at positions where they are very vulnerable to damage and punctures.

Norwegian Pat. No. 135,462 and BRD Offenlegungsschrift No. 2,803,336 disclose thrusters of the above type, but in which the annulus between the tubular tunnels are filled with a sound-absorbing material that eliminates the need for a separate seal member to isolate the annulus from the sea. None of the above publications suggest any specific example of such absorbing material. However, it is evident that if the material is to be capable of displacing the seawater in the annulus it must consist of a material having closed cells or pores, such as a rigid plastic foam or the like, since a soft plastic foam, i.e. a plastic foam with open pores, will absorb the water to a considerable degree rather than displacing it, thus eliminating the sound-dampening effect. This will also be the case if another type of soft sound-insulating material is used such as mats of mineral wool or the like.

The problem is however, that the use of rigid plastic foam or the like as a noise-absorbing, water-displacing material in the annulus fails to provide the desireable effect. This is because a such material, by virtue of being rigid, essentially eliminates the elasticity of the connection between the tubular tunnels, so that a large amount of the noise and vibrations generated by the thruster drive are transmitted to the hull structure. In practice, therefore, the solutions proposed in the two above mentioned publications are of little value.

SUMMARY OF THE INVENTION

The thruster installation according to the present invention incorporates the main features of the above described prior constructions, i.e. a propeller unit rigidly supported in an inner tunnel tube which is elastically supported in a coaxially disposed, outer tunnel tube which in turn is rigidly secured to the hull structure of the ship, with an annulus between the inner and outer tunnel tubes.

The new and specific aspect of the present invention is the fact that the thruster installation comprises means acting to form a plurality of separate gas-filled cavities which during operation of the thruster partly displace the water in the annulus between the tunnel tubes.

The cavities-forming means, which for example may be separate cushions filled with air and having walls of an elastic material, or simply air bubbles formed by continuously injecting air into the annulus, will not have any stiffening effect on the elastic connection between the tunnel tubes while substantially providing the desired noise-dampening. In fact, tests performed at the Norwegian Hydrodynamic Laboratories Trondheim have proved that a mixture of air and water in the annulus between the tunnel tubes provides a significant noise-dampening. Already at 10% air and the remaining volume of the annulus filled with water, the dampening, for large parts of the noise and vibration spectrum, will be at the same order as if the annulus were completely filled with air, i.e. sealed against the sea.

BRIEF DESCRIPTION OF THE DRAWINGS

The invention will be described in further detail below with reference to the drawings in which.

DETAILED DESCRIPTION OF THE INVENTION

Figure 1:
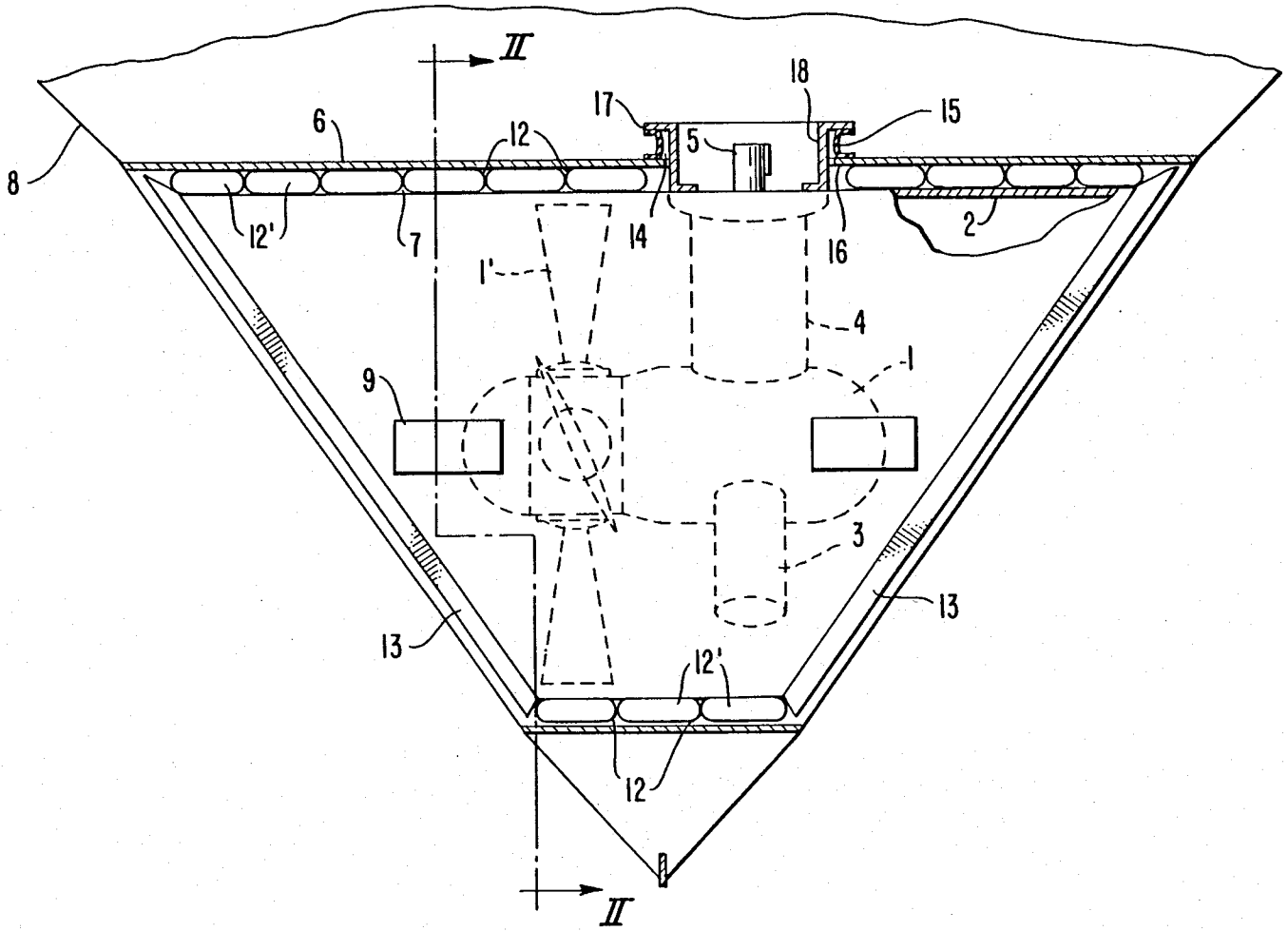
FIG. 1 is an elevational view, partly in section, of a laterally mounted thruster installation constructed in accordance with an embodiment of the invention.

With reference to the drawings, 1 is a conventional thruster propeller unit arranged with its propeller 1' substantially coaxially in an inner tunnel tube 2 extending laterally of the longitudinal axis of the ship and rigidly supporting the thruster unit 1 by means of radially extending arms 3 and a tubular casing 4 surrounding the drive shaft 5 of the propeller unit. The inner tube 2 in its turn is coaxially elastically supported in an outer tunnel tube 6 with a certain spacing between the inner tube 2 and outer tube 6 to form an annulus 7 between the tubes. The outer tube 6 is welded around its openings to the hull structure of the ship at the ship's side 8. Advantageously the outer tube 6 may also be welded to other hull structural members such as longitudinal beams, floor timbers and tank top, in order to enhance the rigidity and strength of the hull and to improve the capability of the outer tube to act as a base for the elastically supported oscillating masses.

The design and dimensions of the elastic connection 9 between the inner tube 2 and outer tube 6 is such as to provide the optimum isolation of vibrations originating from the oscillating system (inner tunnel tube 2 with propeller unit 1 and connection means 3, 4) which is supported in the outer tube 6. The connection may comprise resilient members in the form of a solid elastomer material ("rubber isolators"), and/or gas cushions of an elastomer material ("pneumatic isolators"). The latter type of isolator is particularly favourable since it results in an effective dampening when passing the resonance frequency in the start and stop phase. A person skilled in the art will have no difficulties in constructing such a supercritical elastic support. Therefore, in the drawings this elastic connection is schematically illustrated merely as an example in the form of double spring elements 9' acting against radially extending shoulders 10, 11 suitably circumferentially arranged on the inner tube 2 and outer tube 6 respectively.

According to the invention the thruster installation comprises means acting to form a plurality of separate, gas-filled cavities in the water filling the annulus 7 during operation.

Figure 2:
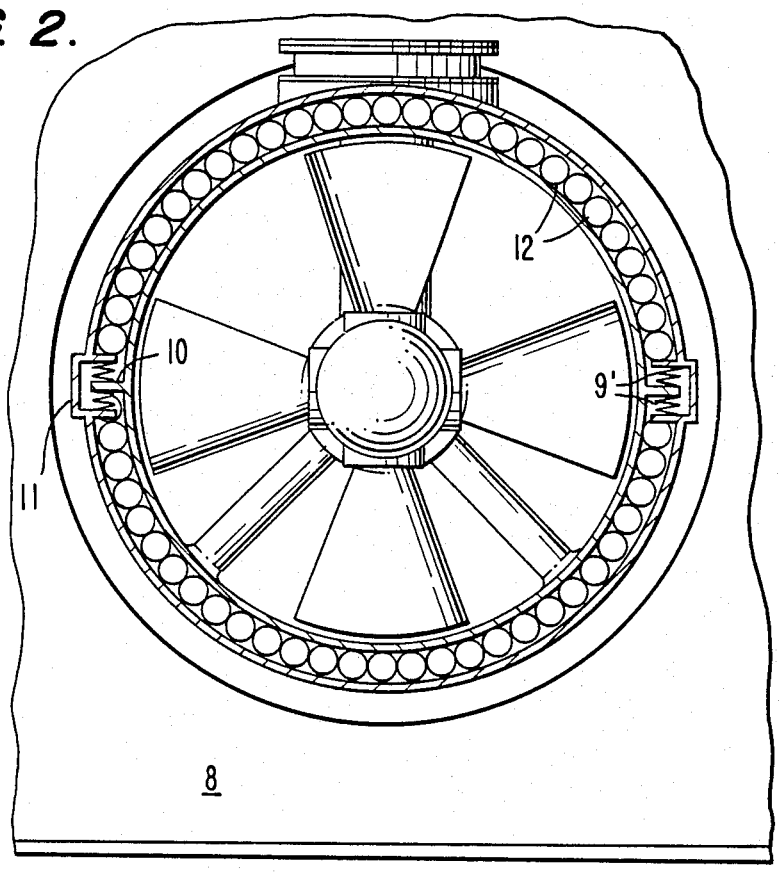
FIG. 2 is a sectional view along the line II—II in FIG. 1.

In the example shown in FIGS. 1 and 2 these means are in the form of a plurality of separate elements or "cushions" 12 each comprising a gas filled cavity 12'. The cushions 12 are distributed around the annulus 7 and displace some of the water therein. These cushions will be made from an elastic material, they will be thin-walled and have a configuration involving the lowest possible "natural" or shell rigidity. Thus, spherical cushions should be omitted.

These gas cushions 12 possess resilient properties close to those of a gas bubble surrounded by water.

In the shown example these gas cushions 12 have a cylindrical shape with thin walls of an elastomer material. Preferably they are filled with air, but if desireable also a different gas may be used.

The inner tube tunnel 2, around its periphery in the opening at the ship's side, is provided with an angularly outwardly extending edge portion 13 which, apart from securing a low turbulence in the water flow through the tunnel and consequently a lower noise level, also serves to retain the air cushions 12 in position in the annulus 7. However, the edge portion 13 terminates with a sufficient spacing from the outer tunnel tube 6 to allow free relative movements of the inner tube 2. One or more hatches or shutters (not shown) may be arranged in the edge portion 13 to allow refilling or replacing of air cushions 12.

Thus, the annulus 7 between the tunnel tubes 2, 6 is open at the ship's side to allow seawater to freely enter between the air cushions 12 situated in the annulus. The only seal that is required is around the opening 14 in the outer tunnel tube where the propeller unit drive shaft 5 passes. In the example shown this is effected by means of a strongly elastic seal ring 15 of generally U-shaped cross section, the respective side surfaces of the seal ring engaging a flange 16 around the outer opening 14 and a flange 17 on a tubular extension 18 of the shaft casing 4 extending through the opening 14 in spaced relation to the outer tube flange 16.

Preferably, if the propeller 1' is driven by an electric or hydraulic motor (not shown) the drive motor is rigidly mounted to a flange which is rigidly connected to the inner tunnel 2, for example the flange 17 of the shaft casing extension 18, opposite the seal ring 15.

By adjusting the volumetric proportion of gas-cavities, which in the example shown are in the form of air cushions 12, relative to the volume of water in the annulus 7, a substantially reduced transmission of pressure pulses through the mixture of water and air cushions to the outer tube 6 will result during operation of the system. Even when the proportion of air cushions in the water is as low as 10% by volume the dampening over parts of the frequency spectrum will be close to that obtained with the annulus 7 completely filled with air. By increasing the volumetric proportion of air cushions beyond 10% a corresponding dampening will be obtained over an increasing frequency range.

Figure 4:
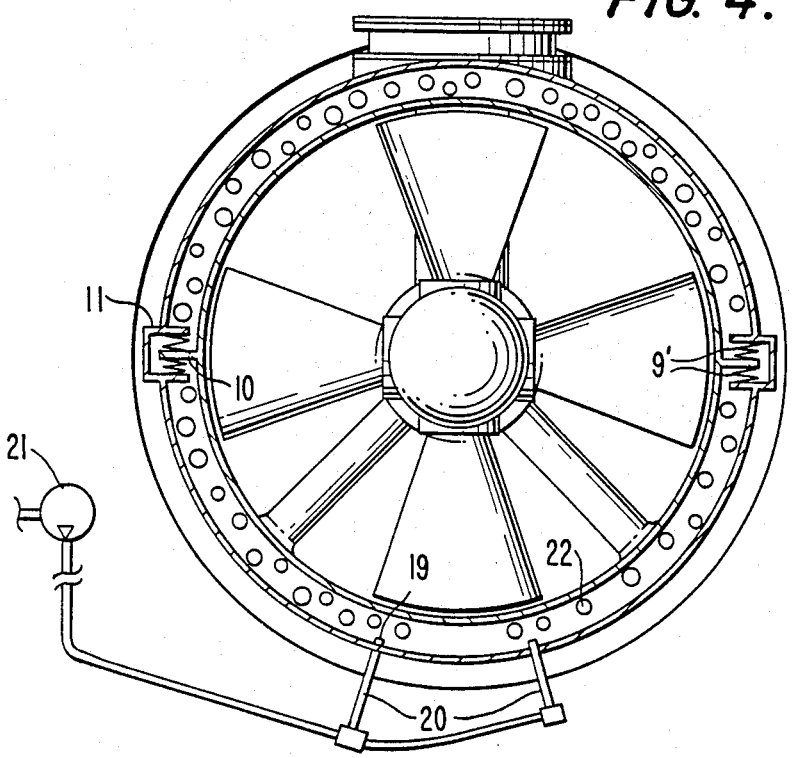
FIG. 4 is a sectional view along the line IV—IV in FIG. 3.
Figure 3:
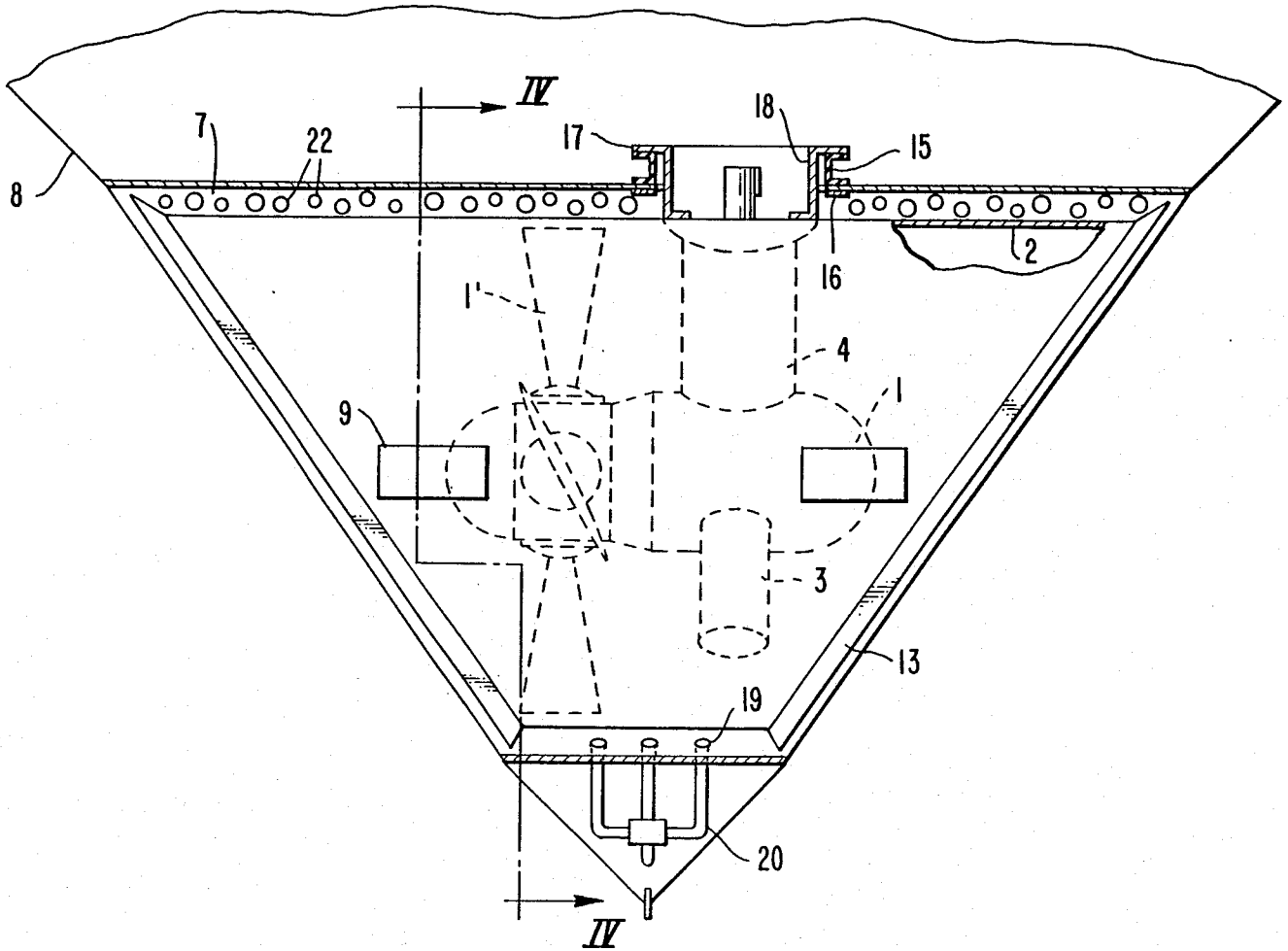
FIG. 3 is an elevational view similar to FIG. 1 but showing another embodiment of the invention.

An alternative embodiment is illustrated in FIGS. 3 and 4. Here gas bubbles 22 are introduced in the annulus 7 by pumping a gas such as air through orifices 19 in the wall of the outer tunnel tube. By arranging a sufficient number of orifices suitably located at the bottom of the tunnel tube, and by connecting these orifices via conduits 20 to an air pump 21, a curtain or cushion of bubbles will be generated in the annulus.

A continuous supply of air will be necessary in order to compensate for the amount of air at any time escaping at the ends of the annulus 7.

However, only small amounts of air are involved, supplied at a low pressure (0.5—1 atm. over pressure). Thus the energy requirements for operating the system are low.

An additional advantage provided by this embodiment is that the amount of air supplied is easily controlled during operation of the thruster installation, allowing an optimum air flow rate setting for varying thruster operational conditions.

We claim:

1. In an elastically supported propeller thruster installation for propulsion and/or steering of a ship, particularly a thruster in which a propeller operates in an open tunnel through the hull of the ship, said installation being of the type including an outer tunnel tube rigidly secured to the hull structure of the ship, an inner tunnel tube, a propeller unit rigidly supported in said inner tunnel tube, connection means for elastically supporting said inner tunnel tube coaxially within said outer tunnel tube with an annulus therebetween, the improvement comprising:

means for supplying a continuous stream of gas into said annulus and thereby for forming a plurality of gas bubbles in said annulus and forming therein sound absorbing means on the form of a cushion of said gas bubbles; and said annulus has opposite ends which are unsealed and open to the surrounding water, thereby enabling escape of said gas bubbles from said annulus.

2. The improvement claimed in claim 1, wherein said gas bubbles occupy at least 10% of the volume of said annulus.

3. The improvement claimed in claim 1, wherein said supplying means comprises a plurality of orifices distributed along the bottom of said outer tunnel tube and connected to a source of gas.

4. The improvement claimed in claim 1, wherein opposite ends of said inner tunnel tube have outwardly extending edge portions spaced from said outer tunnel tube and defining means for retarding passage of said gas bubbles outwardly of said annulus.

* * * * *